US008123052B2

(12) United States Patent
Clark et al.

(10) Patent No.: US 8,123,052 B2
(45) **Date of Patent: *Feb. 28, 2012**

(54) DISPLAY APPARATUS AND METHOD

(75) Inventors: Jeremy A. Clark, Minneapolis, MN (US); Michael A. Whittier, Minneapolis, MN (US); David Cheney, St. Paul, MN (US); Justin Werth, Nowthen, MI (US); Kevin Pittelkow, Richfield, MI (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/181,109

(22) Filed: Jul. 12, 2011

(65) Prior Publication Data

US 2011/0266236 A1 Nov. 3, 2011

Related U.S. Application Data

(62) Division of application No. 12/494,538, filed on Jun. 30, 2009, now Pat. No. 7,997,430.

(51) Int. Cl.
*A47B 43/00* (2006.01)

(52) U.S. Cl. ..... 211/186; 211/189

(58) Field of Classification Search ..... 211/189, 211/186, 187, 86.01, 85.26; 312/237, 234.1, 312/234.4, 140.1–140.4, 137; 108/193, 60, 108/61; 40/606.01, 606.14, 611.01, 611.06, 40/611.08, 611.07, 649

See application file for complete search history.

(56) References Cited

U.S. PATENT DOCUMENTS

| | | | | |
|---|---|---|---|---|
| 1,020,351 | A | 3/1912 | Hill | |
| 1,430,980 | A | 10/1922 | Gideon | |
| 2,987,195 | A | 6/1961 | Smith | |
| 3,110,531 | A | 11/1963 | Nowicki | |
| 3,159,937 | A * | 12/1964 | Barnes | 40/446 |
| 3,200,961 | A | 8/1965 | Kolster et al. | |
| 3,886,698 | A | 6/1975 | Raith et al. | |
| 4,488,652 | A | 12/1984 | Hinton et al. | |
| 4,655,352 | A | 4/1987 | Noyes et al. | |
| 4,655,353 | A | 4/1987 | Johnson et al. | |
| 4,798,013 | A | 1/1989 | Sainato | |
| 4,828,121 | A * | 5/1989 | Willcocks, Jr. | 211/94.01 |
| 4,854,533 | A | 8/1989 | Sainato | |
| 4,936,565 | A | 6/1990 | Fredrickson | |
| 5,014,862 | A | 5/1991 | Bustos | |
| 5,058,300 | A | 10/1991 | Ernest et al. | |
| 5,624,044 | A | 4/1997 | Black, Jr. | |
| 5,687,498 | A | 11/1997 | Keyser et al. | |
| 5,749,479 | A | 5/1998 | Belokin et al. | |
| 5,881,892 | A | 3/1999 | Loo | |
| 5,957,422 | A | 9/1999 | Shea | |
| 6,003,697 | A | 12/1999 | Ferchat et al. | |
| 6,062,399 | A | 5/2000 | Henry et al. | |
| 6,076,295 | A * | 6/2000 | Garfinkle | 40/605 |
| 6,289,618 | B1 | 9/2001 | Kump et al. | |

(Continued)

*Primary Examiner* — Darnell Jayne
*Assistant Examiner* — Patrick Hawn
(74) *Attorney, Agent, or Firm* — Nixon & Vanderhye P.C.

(57) ABSTRACT

Some embodiments of a product display apparatus may include a plurality of product shelves and a product display sign coupled to a support arm in an elevated position above the product shelves so as to define a viewing gap at a selected height. The viewing gap can provide consumers with see-through visibility toward an adjacent aisle. The product display sign may be releasably secured in an elevated support arm that also receives one or more display containers in a position forward of the display sign and above the product shelves.

18 Claims, 11 Drawing Sheets

U.S. PATENT DOCUMENTS

| | | | | |
|---|---|---|---|---|
| 6,340,091 | B1 | 1/2002 | Romeo et al. | |
| 6,364,137 | B1 | 4/2002 | Glauth et al. | |
| 6,405,880 | B1 | 6/2002 | Webb | |
| 6,471,080 | B1 | 10/2002 | Hoffmann | |
| 6,481,132 | B1 | 11/2002 | Grate et al. | |
| 6,976,329 | B1 | 12/2005 | Foster | |
| 7,048,131 | B2 | 5/2006 | Gay et al. | |
| 7,118,000 | B2 | 10/2006 | Shea | |
| 7,175,034 | B2 | 2/2007 | Nook et al. | |
| 7,481,014 | B2 | 1/2009 | Milburn | |
| 7,500,574 | B1 | 3/2009 | Miller et al. | |
| 2002/0027115 | A1 | 3/2002 | Gay et al. | |
| 2002/0033372 | A1 | 3/2002 | Kellogg | |
| 2003/0196972 | A1 | 10/2003 | Webb | |
| 2003/0196974 | A1 | 10/2003 | Cuzzocrea | |
| 2004/0060884 | A1 | 4/2004 | Nook et al. | |
| 2005/0230338 | A1* | 10/2005 | Farinola et al. | 211/186 |
| 2006/0053670 | A1 | 3/2006 | Wiltfang et al. | |
| 2007/0170139 | A1 | 7/2007 | Clark et al. | |
| 2009/0178317 | A1 | 7/2009 | Adams | |

* cited by examiner

DISPLAY APPARATUS AND METHOD

CROSS-REFERENCES TO RELATED APPLICATIONS

This application is a divisional of U.S. patent application Ser. No. 12/494,538, filed Jun. 30, 2009 now U.S. Pat. No. 7,997,430, the entire content of which is hereby incorporated by reference in this application.

STATEMENT REGARDING FEDERALLY SPONSORED RESEARCH OR DEVELOPMENT (Not Applicable)

TECHNICAL FIELD

This disclosure relates to a display apparatus for displaying products, for example, in a retail store environment.

BACKGROUND OF THE INVENTION

Display fixtures can be used in retail stores or other environments to present various products to consumers. The display fixtures may retain the product packages therein in view of the consumers. For example, cosmetics, greeting cards, fashion accessories, magazines, and other products may be displayed in trays or shelves of a designated display fixture. Such a display fixture can be arranged along an aisle in a store so that consumers walking by the display fixture can readily grasp selected products.

Some display fixtures can include product display shelves for retaining and displaying a variety of products to consumers. The shelves can be arranged along a store aisle to allow a consumer to view and select from among the products retained by the display shelves. For example, product display shelves can be used in pharmacy and cosmetic sections to retain various pharmaceutical or cosmetic products. The shelves allow a consumer to view packages of pharmaceutical or cosmetic products arranged in rows or stacks.

In some circumstances, shelves on a product display fixture can be positioned at or above the eye-level height of the average consumer, thereby restricting some consumers' accessibility and visibility of products supported by the shelves. When the consumer's ability to view a product or set of products is restricted by the height of a shelf, the consumer may be unable to locate and purchase a desired product retained by the shelf. In some circumstances, the height of a display fixture is taller than the average consumer. This can restrict the visibility area of a consumer to a single shopping aisle defined by the display fixture and prevent consumers from being able to view other consumers in other shopping aisles and products retained by display fixtures in other shopping aisles.

Some stores provide hanging signage to help consumers navigate between the various aisles or departments of the store. Such ceiling-mounted signage can indicate groups of products that are located in various aisles or areas of a store, thereby assisting consumers in navigating through the store. For example, a hanging sign may indicate that a particular area of the store is the home furnishings area. As another example, a hanging sign may indicate that an aisle includes particular pharmaceutical products. In some instances, navigation signage can be supported by or extend from an endcap of a display fixture. Endcaps can be positioned at the end of a store aisle and may include a particular set of products on display. Signage supported by or extending from an endcap can indicate products or groups of products located within a particular store aisle to allow consumers to easily navigate a store and readily locate a desired product.

Other signage relating to product or brand information may also be hung from the ceiling or mounted on walls. The display fixtures may include one or more signs that describe the type of products retained by the display fixture or describe various uses for products retained by the display fixture. The signage can also display other information relating to products, such as features of the product or price information. Such display signs may be mounted so that a consumer may view the message from a distance. For example, the display sign may be hung from an area of the ceiling near the display fixture while the products are separately retained on the shelves of the display fixture.

BRIEF SUMMARY OF THE INVENTION

Some embodiments of a product display apparatus may include a plurality of product shelves and a product display sign coupled to a support arm in an elevated position above the product shelves so as to define a viewing gap at a selected height. The viewing gap can provide consumers with see-through visibility toward an adjacent aisle, thereby providing an opportunity to view other consumers, products, and displays in adjacent aisles. The support arm that retains the product display sign may also receive one or more display containers in a position forward of the display sign and above the product shelves. Such a configuration may thereby create a three-dimensional exhibit to display one or more selected products above the product shelves in a manner that can attract the attention of consumers.

In some embodiments, a product display apparatus may include a plurality of product display shelves extending in a generally horizontal direction between opposing divider walls and positioned forward of a rear wall. Each of the product display shelves may define an upper surface to support a plurality of products. The apparatus may also include an elevated signage portion mounted above the plurality of product display shelves. The elevated signage portion may include a horizontal support arm that is spaced above an upper edge of the rear wall. The horizontal support arm may define a plurality of channels that each extend in the generally horizontal direction. The apparatus may also include a signage display panel extending substantially the entire distance between the opposing divider walls and releasably engaged with one of the channels of the horizontal support arm so that an image-bearing surface of the signage display panel is retained in a generally vertical orientation. The apparatus may further include a display container toollessly mounted to one of the channels of the horizontal support arm and retained in a position above the product display shelves and forward of the image-bearing surface of the signage display panel. The display container may define a space to releasably receive a plurality of products.

Particular embodiments of a product display apparatus may include a shelf support section separating a first store aisle from a second store aisle and extending generally parallel to the first and second store aisles. The shelf support section may include a base, an upper edge opposite the base, and a vertical array of product support surfaces extending in a horizontal direction between a plurality of vertical side supports. The vertical array of product support surfaces may be positioned above the base and below the upper edge. The apparatus may also include a sign support member mounted to and generally parallel to the upper edge of the shelf support section such that the sign support member and the shelf support section cooperatively define a viewing gap. The bottom edge of the viewing gap may be positioned at a height of about 54 inches to about 68 inches, and the viewing gap may extend vertically for a distance of about 4 inches to about 18 inches. The apparatus may also include a product display sign removably mounted to the sign support member in an elevated position above the upper edge of the shelf support section. The product display sign may include one or more images on a front surface that is retained in a generally vertical orientation when the product display sign is removably mounted to the sign support member. The viewing gap may be substantially unobstructed so as to provide line-of-sight viewing between the first and second aisles.

Some embodiments of a method for displaying products may include arranging a product display apparatus between a first store aisle and an adjacent store aisle. The product display apparatus may include a first set of horizontal shelf surfaces facing toward the first store aisle, a second set of shelf surfaces facing toward the adjacent store aisle, and at least one rear wall separating the first and second sets of horizontal shelf surfaces. The method may also include placing a plurality of products on the first and second sets of horizontal shelf surfaces so that the plurality of products are accessible from at least one of the first store aisle and the adjacent store aisle. The method may further include mounting an image-bearing panel in an elevated position above the rear wall of the product display apparatus so as to define a see-through opening between the image-bearing panel and the rear wall. The see-through opening may provide visibility at a selected height range from the first store aisle to the adjacent store aisle. The image-bearing panel may include a front surface having images related to at least one of the products accessible from at least one of the first store aisle and the adjacent store aisle. The method may also include inserting one or more embedded display window structures into one or more corresponding cavities formed in a front surface such that a front face of each embedded display window structure is positioned forward of the front surface of the image-bearing panel. Each embedded display window structure may carry one or more products or images related to at least one of the products accessible from at least one of the first store aisle and the adjacent store aisle.

These and other embodiments described herein may provide one or more of the following benefits. First, the display apparatus may include an elevated signage portion that is spaced above a shelf support section, which can draw more attention from consumers located a distance away from the immediate store aisle. Second, the elevated signage portion may also provide a see-through visibility gap (between the elevated signage portion and the shelf support section) that provides consumers with the opportunity to view products, displays, and other consumers in an adjacent aisle. Third, the elevated signage portion can be configured to receive one or more display containers that extend forwardly from the front plane of the image-bearing product sign. As such, the elevated signage portion can provide a three-dimensional exhibit that further attracts consumers to a targeted set of products arranged in the display container. Fourth, the elevated signage portion can be configured to receive one or more embedded display window structures that provide added texture and attention-drawing features to the elevated signage portion while also retaining a number of selected products in a sample or diorama-like display.

Some or all of these and other benefits may be provided by the apparatus and methods described herein.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
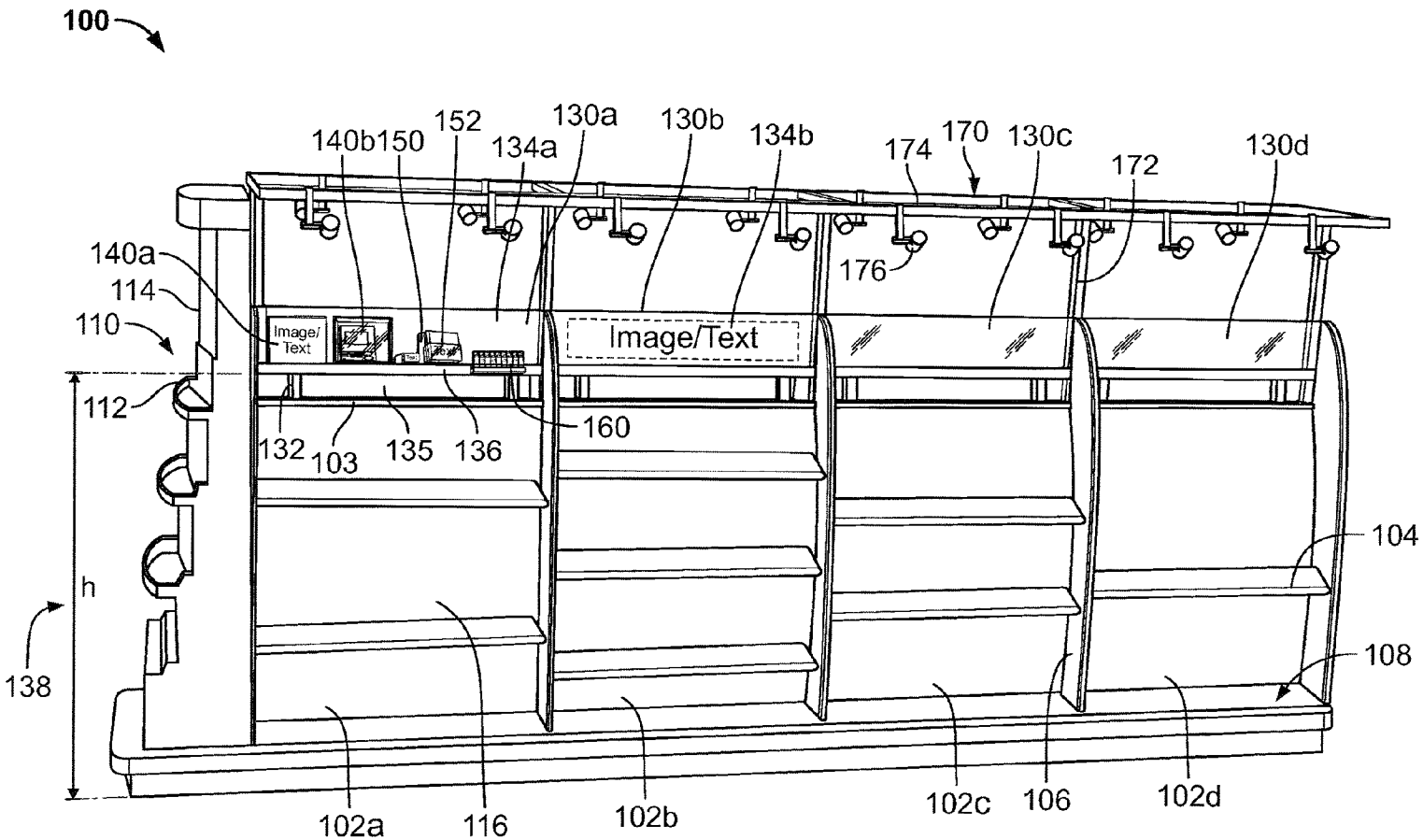
FIG. 1 is a perspective view of a display apparatus, in accordance with some embodiments.

Referring to FIG. 1, some embodiments of a retail display apparatus 100 can be configured to display a variety of products, images related to available products, or a combination thereof. The retail display apparatus 100 includes a number of shelf support sections 102*a-d* separated by dividers 106. The dividers 106 can both physically and visually separate the shelf support sections 102*a-d*. Each shelf support section 102*a-d* can include one or more shelves 104. The shelves 104 can retain a number of retail products thereon. For example, the shelves 104 can display a variety of cosmetic products to allow consumers passing by the retail display apparatus 100 to view and select from among the variety of cosmetic products. As another example, the shelves 104 can display a number of apparel products such as folded shirts and pants to allow consumers to view the apparel products and select a desired size and style from among the apparel products. Each shelf support section 102*a-d* additionally includes a base portion 108. The base portions 108 may also serve as the lowest shelf so as to retain and display retail products in a similar manner as described above for the shelves 104.

The display apparatus 100 may be arranged between a first store aisle and a second, adjacent store aisle. In such circumstances, the apparatus 100 may include shelf support sections 102 on both sides. For example, the shelf support section 102*a* may include a first set of shelves 104 that face toward the first store aisle while an oppositely disposed shelf section (not shown in FIG. 1) may include a second set of shelves that face toward the second store aisle. At least one rear wall 116 may separate the first set of shelves 104 from the oppositely disposed shelves that face toward the second aisle. For example, each shelf support section 102*a-d* can include a respective rear wall 116 that extends between the dividers 106. Each rear wall 116 may extend upward from the base portion 108 to an upper edge 103 of the shelf support sections 102. In some embodiments, the rear wall 116 of a shelf support section 102*a* can be arranged back-to-back with a rear wall of an oppositely disposed shelf support section (that faces toward the second store aisle).

In some embodiments, the retail display apparatus 100 can include an endcap display 110 on one or both of the ends of the retail display apparatus 100. The endcap display 110 can include a number of display racks 112 for retaining and displaying retail products. For example, the display racks 112 can display a plurality of moisturizers, lotions, or other cosmetic products to attract consumers passing by the retail display apparatus 100. The endcap display 110 can additionally include an endcap sign 114 for displaying product information. In some embodiments, the endcap sign 114 can display information relating to various sales promotions. In some embodiments, the endcap sign 114 can display a decorative graphic to enhance the aesthetic appearance of the retail display apparatus 100.

Still referring to FIG. 1, in accordance with some embodiments, the retail display apparatus 100 includes a number of elevated signage portions 130*a-d*. The retail display apparatus 100 can include an elevated signage portion 130*a*, 130*b*, 130*c*, 130*d* extending above each of the shelf support sections 102*a*, 102*b*, 102*c*, 102*d*, respectively. For example, the retail display apparatus 100 can include the elevated signage portion 130*a* that extends above the shelf support section 102*a*. In some embodiments, the elevated signage portion 130*a* is coupled to the shelf support section 102*a* by one or more vertical supports 132 that extend upward beyond the upper edge 103 of the shelf support section 102*a*. It should be understood that, in some embodiments, the vertical supports 132 may be concealed behind the dividers 106 or integrally formed with the dividers 106.

In some embodiments, the elevated signage portions 130 can include a display panel 134. For example, the elevated signage portion 130*b* can include the display panel 134*b* that communicates product information, images of products, information relating to various sales promotions, or decorative graphics to enhance the aesthetic appearance of the elevated signage portion 130*b*. In some embodiments, the display panel 134 can be supported by a horizontal support 136. For example, the horizontal support 136 can retain and display the first display panel 134*a*. The horizontal support 136 can be coupled to the vertical supports 132 and receive one or more edges of the display panel 134*a*. In some embodiments, the horizontal support 136 can include a first horizontal channel for receiving and retaining an edge of the display panel 134*a*. As described in more detail below in connection with FIG. 7, the first channel can be generally u-shaped and be sized to receive the bottom edge of the display panel 134*a* and also contact lower portions of the front and rear surfaces of the display panel 134*a*. In such circumstances, the first channel of the horizontal support 136 can provide a friction fit to releasably retain the display panel 134*a* in an upright position. The first channel can allow a user of the retail display apparatus 100 to readily secure the display panel 134*a* to the retail display apparatus 100 without the use of tools.

In some embodiments, the horizontal support 136 is spaced above the upper edge 103 of the shelf support section 102*a* so as to create a gap 135 which allows see-through visibility to the opposing side of the retail display apparatus 100. For example, if the retail display apparatus 100 is positioned along an aisle of a store, the gap 135 can allow a customer to see-through the retail display apparatus 100 to the next aisle. In some embodiments, the horizontal support 136 can be positioned at a height 138 so that the gap 135 is positioned at about eye level for an average adult consumer. In some embodiments, the height 138 can be about 48 inches to about 70 inches, about 54 inches to about 68 inches, and (in this embodiment) about 60 inches to about 66 inches.

By spacing the elevated signage portion 130 above the shelf support section 102, the elevated signage portion 130 may draw more attention from consumers from a further distance away than if the elevated signage portion where mounted directly to the upper edge 103 of the shelf support section 102*a*. Also, the see-through visibility gaps 135 between the elevated signage portions 130 and the shelf support sections 102 provide consumers with the opportunity to view products and displays in adjacent aisles. The see-through visibility provided by the gap 135 also creates a sense of openness as a consumer in one aisle can readily view consumers in an adjacent aisle of the retail store environment.

In accordance with some embodiments, the elevated signage portion 130 can include one or more embedded display windows 140*a-b*. The embedded display windows 140*a-b* can be embedded within the display panel 134*a* of the elevated signage portion 130*a*. In some embodiments, the embedded display windows 140*a-b* can extend forward beyond the front plane of the display panel 134*a*. The embedded display windows 140*a-b* can be configured to retain and display a number of products (e.g., a sample collection of products retained on the shelves 104 below) and information relating to the products in an enclosed case. For example, the embedded display windows 140*a-b* can display various cosmetic products, such as blush, lipstick, eyeliner, and foundation in a variety of colors and styles. The embedded display windows 140*a-b* can additionally display information on suggested uses for the products, or images that demonstrate suggested combinations of products. The embedded display windows 140*a-b* can have a transparent front surface to allow consumers to view the products and information displayed by the embedded display windows 140*a-b* while preventing the consumers from being able to remove the products from the embedded display windows 140*a-b*.

In some embodiments, each embedded display window 140*a-b* can have an opaque front surface. Each opaque front surface can include a sign for displaying product information, images of products, information relating to various sales promotions, or decorative graphics to enhance the aesthetic appearance of the retail display apparatus 100. In alternative embodiments, the front surface of each embedded display window 140*a-b* can be partially opaque and partially transparent. For example, the left half of the embedded display window 140*a* may be transparent and display a variety of fashion accessories while the right half of the embedded display window 140*a* may be opaque and include an image of a person wearing one or more of the fashion accessories displayed in the left half of the embedded display window 140*a*. As another example, the front surface of the embedded display window 140*b* may be made from a transparent material with a graphic printed on the front surface with an opaque or translucent ink layer. In this example, the areas not covered by the ink layer would be transparent, while the areas covered by the ink layer would be opaque or translucent. In other embodiments, all or part of the front surfaces of the embedded display windows 140*a-b* may be translucent.

Still referring to FIG. 1, in accordance with some embodiments, the elevated signage portion 130*a* can include one or more removable display racks 150. The removable display rack 150 is supported by the horizontal support 136 and is positioned in front of the display panel 134*a*, thereby providing an added dimension to the elevated signage portion 130*a*. In some embodiments, the removable display rack 150 is held in place by a second channel of the horizontal support 136. As described in more detail below in connection with FIG. 7, the second channel can be generally u-shaped and can be sized to removably receive an edge of the display rack 150. In some embodiments, the display rack 150 can include one or more compartments 152 for holding retail products related to the products retained on the shelves 104 below. For example, the display rack 150 can include a compartment 152 for holding gift cards with images indicative of the products on the shelves 104 below. As another example, the display rack 150 can include a compartment 152 for holding books related to the products on the shelves 104 below. As another example, the display rack 150 can include a compartment 152 for holding pamphlets that communicate information on products displayed by the retail display apparatus 100.

Still referring to FIG. 1, in accordance with some embodiments, the elevated signage portion 130*a* can include a removable display container 160. The removable display container 160 can be configured to retain and display various retail items, such as a collection of selected products retained on the shelves 104 below. For example, the display container 160 can be used to display a number of lipsticks or other cosmetics of a particular color scheme selected from the larger group of lipsticks or other cosmetics retained on the shelves 104 below. Accordingly, the display container 160 can act as a demonstrative for consumers seeking guidance on how to select a particular set of cosmetic products (e.g., a set for a particular color scheme, a set of a particular combination of product types, or the like). As another example, the display container 160 can be used to display various makeup application sponges. In some embodiments, the display container 160 can include a mounting clip (described in more detail below) for engaging the second channel of the horizontal support 136. The mounting clip can be sized so as to form a friction fit with the second channel when the display container 160 is mounted to the horizontal support 136.

In some embodiments, the display container 160 can extend at least partially below the horizontal support 136 to partially block the see-through visibility gap 135 between the shelf support section 102 and the elevated signage portion 130. In such circumstances, the display container 160 allows visibility of the portion of the display panel 134*a* that is located above the display container 160 while also drawing attention to the selected products featured in the display container 160. This allows a customer to view graphics, or information located on that portion of the display panel 134*a*. In some embodiments, the display container 160 can extend above the horizontal support 136 so as to not block the see-through visibility gap 135 and provide an added dimension to the elevated signage portion 130*a*.

Because the display container 160 can releasably mount directly to the elevated signage portion 130*a*, the display container 160 can position selected products in close proximity to information relating to the products conveyed by the display panel 134*a*. For example, the display container 160 can retain and display a number of cosmetic products, and the display panel 134*a* can include suggested uses or pairings of the cosmetic products retained by the display container 160. As another example, the embedded display window 140*b* can feature a display promoting a new lipstick shade. In this example, the display container 160 can include a quantity of lipsticks corresponding to the shade promoted by the embedded display window 140*b* to allow consumers attracted by the display of the embedded display window 140*b* to readily obtain one or more of the lipsticks. In addition, the display container 160 can extend in a forward direction beyond the front plane of the display panel 134*a*; thereby creating a three-dimensional exhibit for the elevated signage portion 134*a* that can attract the attention of consumers, especially consumers that are looking in a direction that is substantially parallel to the display panel 134*a*. Also, in some embodiments, the display container 160 can be mounted at an elevated height that is about eye-level for an average adult consumer, thereby more readily drawing the attention of consumers than shelves or other product displays positioned above or below eye level.

In accordance with some embodiments, the retail display apparatus 100 includes an integrated lighting fixture 170. The integrated lighting fixture 170 can include vertical supports 172 for supporting the integrated lighting fixture 170. In some embodiments, the vertical supports 172 can extend above the shelf support sections 102 so as to be spaced above the elevated signage portions 130. The integrated lighting fixture 170 can include horizontal supports 174 extending between the vertical supports 172. The horizontal supports can support a number of lights 176. The lights can be positioned so as to illuminate portions of the elevated signage portions 130 and the shelf support sections 102.

Figure 2:
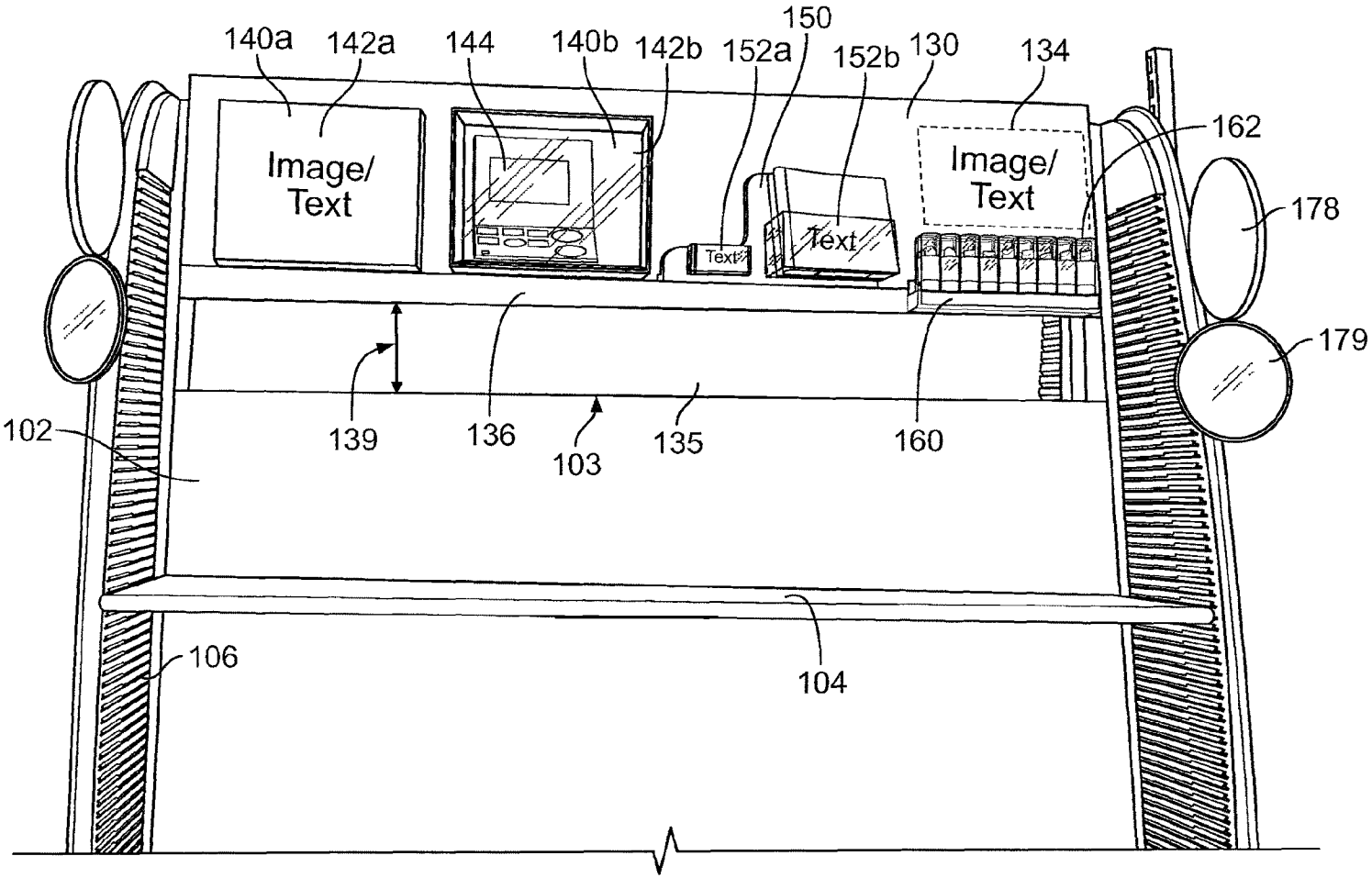
FIG. 2 is a close up view of a shelf support section and an elevated signage portion of the display apparatus of FIG. 1, in accordance with some embodiments.

Referring now to FIG. 2, each elevated signage portion 130 is positioned above the respective shelf support section 102 to create the see-through visibility gap 135. In this embodiment, the vertical supports 132 are generally concealed from view by the dividers 106, thereby providing a generally continuous gap 135 between the dividers 106 and above the upper edge 103 of the shelf support section 102. The gap 135 is formed between the horizontal support 136 and the upper edge 103 of the shelf support section 102 and has a gap height 139. In some embodiments, the gap height 139 can be about 1 inch to about 24 inches, about 2 inches to about 18 inches, about 3 inches to about 12 inches, and (in this embodiment) about 4 inches to about 6 inches. In some embodiments, the gap height 139 can be about 4 inches to about 18 inches. In the example depicted, the elevated signage portion 130 extends a horizontal distance that is about the distance between the dividers 106. In other embodiments, the elevated signage portion 130 can extend a horizontal distance that is substantially less than the distance between the dividers 106.

The elevated signage portion 130 includes the display panel 134. The display panel 134 is supported by the horizontal support 136. The bottom edge of the display panel 134 engages a first channel of the horizontal support 136 as described above in connection with FIG. 1. As described above, the horizontal support 136 can include a second channel for supporting display racks and display containers. Both the first and second channels can be u-shaped. In some embodiments, the horizontal support 136 can include a third channel (refer to FIG. 7) that runs parallel to the first and second channels and is positioned along side the first channel on a side of the first channel opposite of the second channel, as described in more detail below with reference to FIG. 7. The third channel can releasably retain a second display panel distinct from the display panel 134 in the same manner that the first channel retains the display panel 134. The second display panel can display text, images, and products to consumers facing a side of the elevated signage portion 130 that is opposite of the side shown in FIG. 2.

Still referring to FIG. 2, in this embodiment, the elevated signage portion 130 includes embedded display windows 140*a* and 140*b* that are removably seated in corresponding apertures in the display panel 134. The embedded display windows 140*a* and 140*b* include front faces 142*a* and 142*b* respectively that extend forward beyond the front plane of the display panel 134, thereby providing a three-dimensional demonstrative or exhibit to the viewer. In the example depicted, the front face 142*a* of the embedded display window 140*a* is generally opaque. The front face 142*a* can include text, images, or a combination thereof relating to products displayed on one or more shelves 104 below the embedded display window 140*a* or products displayed elsewhere by a retail display that includes the embedded display window 140*a*. For example, a number of shoes, boots, and other footwear items may be positioned on the shelf 104. The front face 142*a* can include one or more images of people wearing one or more of the footwear items displayed on the shelf 104. The images can include suggested apparel items to pair with one or more of the footwear items in order to create one or more outfits. As another example, the front face 142*a* can include text suggesting various looks that can be achieved using a variety of cosmetic products displayed by the retail display that includes the embedded display window 140*a*. For example, the front surface 142*a* can include text that suggests a particular shade of eye shadow as being suitable for a particular occasion while suggesting corresponding lipstick and blush shades that can be paired with the eye shadow.

In other embodiments, the front face 142*a* of the embedded display window 140*a* can be coated with a reflective material to allow the embedded display window 140*a* to act as a mirror. For example, a variety of cosmetic product samples may be retained and displayed by the elevated signage portion 130 or on the shelf 104. By being reflective, the front surface 142*a* can allow consumers to try on the cosmetic product samples and view themselves while wearing the cosmetic products.

Still referring to FIG. 2, in the example depicted, the front face 142*b* of the embedded display window 140*b* is generally transparent. The generally transparent front face 142*b* allows consumers to view one or more products 144 retained within the embedded display window 140*b* without being able to remove the products from the embedded display window 140*b*. This allows the embedded display window 140*b* to present a diorama-like display of a selected collection of products 144 (e.g., which may be selected from a larger group of products retained on the shelves 104 below). In some embodiments, the embedded display window 140*b* can retain one or more signs which include images or text relating to the products 144. For example, the products 144 can be a number of cosmetic products intended for a particular season. The embedded display window 140*b* can include a sign positioned adjacent to or behind the products 144 (e.g., on a rear face) depicting an image of a model wearing the selected cosmetics. As another example, the products 144 can be a variety of earrings. The embedded display window 140*b* can include a sign positioned adjacent to or behind the products 144 (e.g., on a rear face) depicting an image of people wearing one or more of the variety of earrings.

In some embodiments, the front face 142*a* of the embedded display window 140*a* can include text or images relating to the products 144 displayed within the embedded display window 140*b*. For example, the product 144 can be a cosmetic case which includes a variety of lip glosses, blushes, eye shadows, and eye liners in various shades. The front face 142*a* of the embedded display window 140*a* can include text describing a look that can be made using one or more of the cosmetics included in the cosmetic case displayed in the embedded display window 140*b*. As another example, the front face 142*a* can include an image of a person wearing one or more of the cosmetics displayed within the embedded display window 140*b*.

Still referring to FIG. 2, in accordance with some embodiments, the elevated signage portion 130 includes at least one display rack 150. The display rack 150 can be retained by the second channel of the horizontal support 136 as described below in connection with FIG. 7. The main portion of the display rack 150 can extend above the horizontal support 136 in a direction that is substantially parallel to the front surface of the display panel 134. The display rack 150 includes compartments 152*a* and 152*b* for retaining products or literature relating to the displayed products. In some embodiments, the compartment 152*a* can be configured to hold gift cards that can be used to purchase one or more of the products 144 displayed by the embedded display window 140*b* or other products located in a store that includes the display rack 150. The gift cards can include images related to products displayed by the elevated signage portion 130 or on the shelf 104 below. For example, a number of cookware items can be displayed on the shelf 104. The compartment 152*a* can retain and display gift cards with images of one or more of the cookware items that can be used to purchase the cookware items or other products located in a store which includes the display rack 150.

In some embodiments, the compartment 152*b* can be configured to hold books, pamphlets, or other literature related to products displayed by the retail display. For example, following the example where the shelf 104 is displaying a number of cookware items, the compartment 152*b* can retain and display a number of cookbooks to allow consumers to view and select from among the cookbooks. By placing the cookbooks in close proximity to the cookware, a consumer is able to easily select and purchase a cookbook without having to search through a different section of the store. As another example, a number of cosmetic products can be displayed within the embedded display window 140*b* or on the shelf 104. The compartment 152*b* can retain and display one or more books on applying makeup and pairing various makeup shades with each other. As yet another example, a number of hiking related products can be displayed on the shelf 104. The compartment 152*b* can retain and display maps of various hiking trails.

In some embodiments, the compartments 152*a* and 152*b* can display various products. For example, the compartment 152*a* can display a variety of wristbands and the compartment 152*b* can display a variety of headbands in various colors. As another example, the compartment 152*a* can display a variety of yo-yos and the compartment 152*b* can display books on how to perform yo-yo tricks.

Still referring to FIG. 2, in accordance with some embodiments, the elevated signage portion 130 includes at least one display container 160 mounted forward of the display panel 134. The display container 160 can be configured to releasably mount to the second channel of the horizontal support 136 as described below in connection with FIG. 7. The display container 160 can retain a variety of products 162. For example, the display container 160 can display a variety of products depicted on the front surface 142*a* of the embedded display window 140*a* or retained within the embedded display window 140*b*. For example, the products 162 can be various shades of cosmetic products displayed within the embedded display window 140*b*. In some embodiments, the products 162 can be the same as or similar to the products 144 to allow consumers to easily obtain products displayed within the embedded display window 140*b*. By retaining the products 162 in close proximity to the embedded display window 140*b*, the display container 160 allows consumers to easily obtain and purchase desired products that are the same as or similar to the products 144 that can be viewed by, but are not accessible to consumers. By extending in a forward direction beyond the front plane of the display panel 134*a*, the display container 160 creates a three-dimensional look for the elevated signage portion 134*a* that can attract the attention of consumers. Furthermore, the display container 160 provides an opportunity to showcase a particular subset of products 162 from the larger group of products displayed on the shelf 104 below. Accordingly, the consumer's attention may be drawn toward the targeted or showcased set of products 162.

In some embodiments, the display panel 134 includes images, text, or both in the area above or behind the display container 160. The images and text can be related to the products 162 displayed by the display container 160. For example, the products 162 can be a variety of lipsticks and the display panel 134 can include an image of a person wearing one of the lipstick shades displayed within the display container 160. As another example, the products 162 can be a set of candies, and the display panel 134 can include images of children enjoying the candies. In some embodiments, the display container 160 can retain products that are related to other products displayed on the shelf 104 or elsewhere on a retail display that includes the display container 160. For example, camping related products, such as tents, small portable grills, and backpacks can be displayed on the shelf 104. In this example, the products 162 displayed by the display container 160 can be compasses. As another example, a variety of swimsuits can be displayed on the shelf 104 and the products 162 can be various containers of sunscreen.

Still referring to FIG. 2, in accordance with some embodiments, the shelf support section 102 can include signs 178 and mirrors 179 mounted to the dividers 106. The signs 178 can communicate product information, images of products, information relating to various sales promotions, or decorative graphics. For example, the signs 178 can display various trademarks or logos associated with products displayed by the elevated signage portion 130 and the shelf support section 102. By extending from the dividers 106, the signs can attract the attention of consumers, especially consumers that are looking in a direction that is substantially parallel to the display panel 134. The mirrors 179 can allow consumers to view themselves while trying out various products. For example, the compartments 152*a-b* may display a variety of sunglasses. The mirrors 179 can allow consumers to view themselves while wearing the sunglasses. As another example, the display container 160 can display a variety of cosmetic product samples. The mirrors 179 can allow consumers to view themselves while wearing one or more of the cosmetic product samples. As another example, a variety of apparel items such as hats and shirts may be arranged on the shelf 104. The mirrors 179 can allow consumers to view themselves while wearing one or more of the apparel items.

Figure 3:
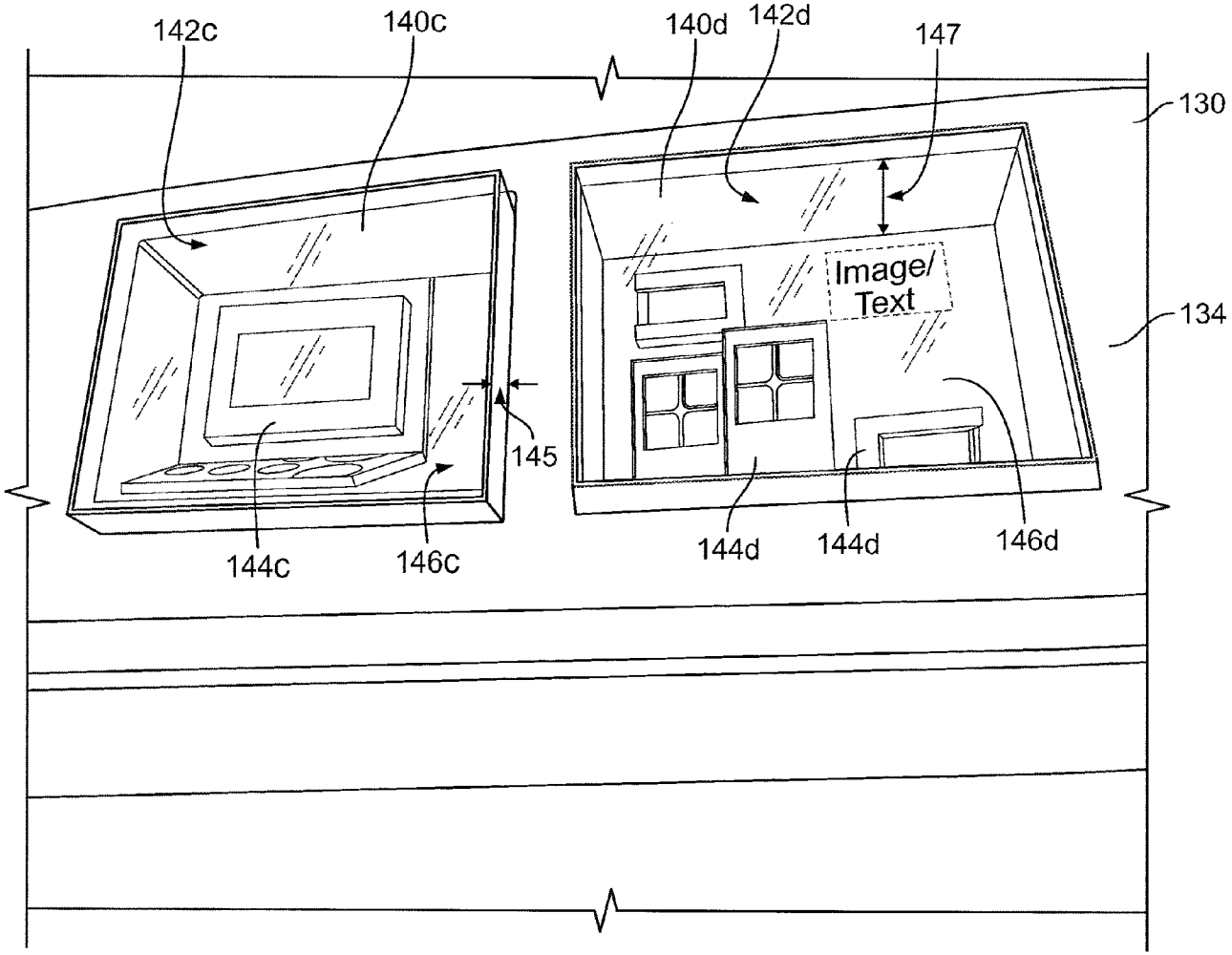
FIG. 3 is a perspective view of embedded display windows for the elevated signage portion, in accordance with some embodiments.

Referring now to FIG. 3, in accordance with some embodiments, embedded display windows 140*c* and 140*d* are partially disposed within respective cavities of the display panel 134. The display panel 134 is supported by a horizontal support as described above with reference to FIG. 1. The embedded display windows 140*c* and 140*d* include front faces 142*c* and 142*d* respectively. In some embodiments, the front faces 142*c-d* extend in a forward direction beyond the front surface of the display panel 134 a distance 145. In some embodiments, the distance 145 can be about one eighth of an inch to about three inches, about one quarter of an inch to about two inches, and (in this embodiment) about one half of an inch to one inch. In other embodiments, the front faces 142*c-d* can be substantially flush with the front surface of the display panel 134. In the embodiment depicted, the front faces 142*c-d* are substantially flat. In some embodiments, all or portions of the front faces 142*c-d* can be concave or convex.

The embedded display windows 140*c* and 140*d* include rear faces 146*c* and 146*d* respectively. In some embodiments, the rear faces 146*c-d* are substantially parallel to the front faces 142*c-d*. In some embodiments, the rear faces 146*c-d* extend backward from the front surface of the display panel 134 a distance 147. In some embodiments, the distance 147 can be about one quarter of an inch to about five inches, about one half of an inch to four inches, and (in this embodiment) about one inch to about three inches.

Still referring to FIG. 3, in the example depicted, the front faces 142*c-d* are generally transparent to allow consumers to view products 144*c* and 144*d* contained respectively within the embedded display windows 140*c* and 140*d*. For example, the products 144*c* can be selected shades of blush and the other products 144*d* can be corresponding shades of eye shadow. The generally transparent front faces 142*c-d* allow consumers to view the products 144*c-d* without being able to move the products 144*c-d* or remove the products 144*c-d* from the embedded display windows 140*c-d*.

In some embodiments, the rear faces 146*c-d* can include text and images related to the products 144*c-d* display within in the embedded display windows 140*c-d*. For example, the products 144*d* can be sunglasses. The rear face 146*d* can include images of a person wearing the sunglasses, or text conveying information about the sunglasses, such as UV-protection factor of the sunglasses, or warranty information related to the sunglasses. As another example, the products 144*c* and 144*d* can be selected shades of two different brands of lipstick. The rear face 146*c* can include an image of a logo or brand name of the lipsticks displayed within the embedded display window 140*c*, and the neighboring rear face 146*d* can include an image of a logo or brand name of the lipsticks displayed within the neighboring display window 140*d*. In other embodiments, the embedded display windows 140*c-d* can include no products for display so as to draw attention to the text or images on the rear faces 146*c-d* or on the front faces 142*c-d*.

In some embodiments, the front faces 142*c-d* can be translucent. For example, the front face 142*c* can be tinted with a red hue or another hue. As another example, the front face 142*d* can include a translucent image of a popular cartoon character and the products 146*d* therein can be toys related to the cartoon character. In some embodiments, the front faces 140*c-d* can be partially opaque and partially transparent. For example the left half of the front face 142*d* can be generally transparent to allow consumers to view some or all of the products 144*d*, while the right half of the front surface 142*d* can be opaque and include text, images, or both relating to the products 146*d*. As another example, the products 144*c* can be running shoes, and the left half of the front surface 142*c* can be transparent or translucent to allow consumers to view the running shoes. The right half of the front surface 142*c* can be opaque and include text that conveys information on the health benefits of running.

Because the embedded display windows 140*c-d* extend forwardly beyond the front surface of the display panel 134, the embedded display windows 140*c-d* create a three-dimensional look to the elevated signage portion 130 that includes the display panel 134, thereby more readily attracting the attention of consumers. Additionally, by retaining and displaying actual products 144*c-d* available on the shelves 104 below, the embedded display windows 140*c-d* add an extra element of depth to the elevated signage portion 130.

Figure 4A:
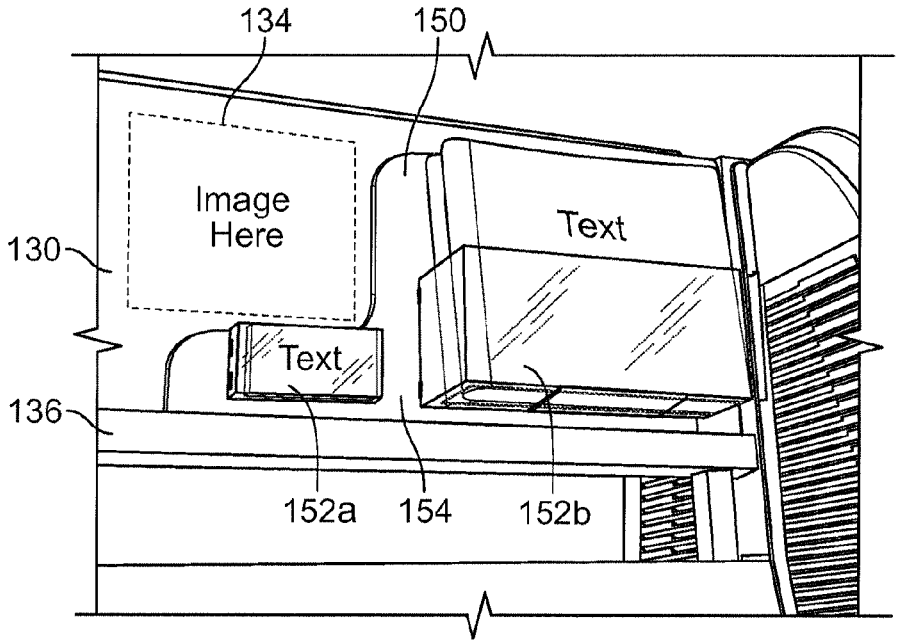
FIGS. 4A-4B are perspective views of a removable display rack for the elevated signage portion, in accordance with some embodiments.
Figure 4B:
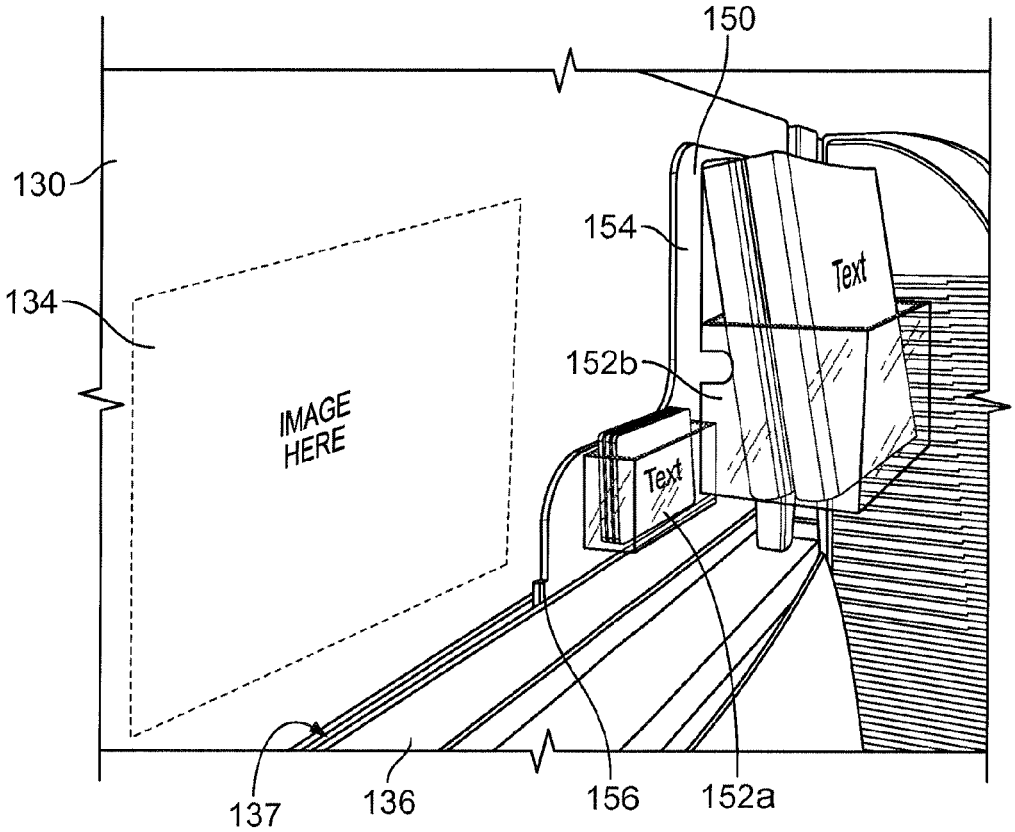

Referring now to FIGS. 4A-B, some embodiments of the removable display rack 150 are supported by the horizontal support 136 of the elevated signage portion 130. The display rack 150 may be positioned so as to partially block a portion of a display panel 134 retained by a first channel of the horizontal support 136. The display rack 150 in this embodiment includes a main portion 154 and a mounting portion 156. The main portion 154 can be constructed from a single flat piece of a sheet material such as plastic, cardboard, paperboard, foamcore board, or poster board. In the example depicted, the main portion 154 extends upward from the horizontal support 136 in a direction that is substantially parallel to the display panel 134. The mounting portion 156 (as shown in FIG. 4B) can be configured to releasably engage a second channel 137 of the horizontal support 136. In some embodiments, the second channel 137 is u-shaped and includes two opposing inner sides that form right angles with a bottom surface. In some embodiments, the mounting portion 156 can be thicker than the main portion 154 so as to be wide enough to engage both of the opposing inner sides of the second channel 137. By engaging both of the opposing inner sides, the mounting portion 156 forms a friction fit with the second channel 137. The friction fit secures the display rack 150 in the operative position while allowing the display rack 150 to be readily removed from the horizontal support 136 by hand without the use of handheld tools and repositioned elsewhere on the horizontal support 136 or on a different horizontal support. In some embodiments, the mounting portion 156 can easily slide within the second channel 137 to allow the display rack 150 to be readily repositioned along the horizontal support 136. In some embodiments, the mounting portion 156 can extend in a vertical direction so as to engage the bottom surface of the second channel 137. In some embodiments, the mounting portion 156 can be the same thickness as the main portion 154. In some embodiments, the main portion 154 can be thicker than the mounting portion 156.

As previously described, the display rack 150 includes compartments 152*a* and 152*b* for retaining and display products or information related to products. For example, the compartment 152*b* can retain and display a number of handheld Global Positioning System units and the compartment 152*a* can retain and display pamphlets on how to use the Global Positioning System units. The compartments 152*a* and 152*b* extend in a forward direction from the front surface of the main portion 154. In some embodiments, the compartment 152*b* can extend a greater distance than the compartment 152*a*. Also, the compartments 152*a* and 152*b* can be partially disposed within the main portion 154. The front surface (and optionally the bottom and side surfaces) of the compartments 152*a-b* can be transparent or translucent to allow consumers to more readily view the products retained by the compartments 152*a-b*. In some embodiments, the compartments 152*a-b* can include text or images relating to the products being retained by the compartments 152*a-b*. For example, the compartment 152*b* can retain and display various hair care products and the compartment 152*b* can include text reading "marked down 50% from original price." As another example, the compartment 152*b* can retain and display books on dieting and the compartment 152*b* can include text conveying various credentials and achievements of the author of the books.

In some embodiments, the display panel 134 can include text, images, or both related to the products retained by the compartments 152*a-b*. For example, the display panel 134 can include images of various cosmetic products. In this example, the compartment 152*a* can retain and display gift cards that can be used to purchase the various cosmetic products, and the compartment 152*b* can retain and display books detailing various ways to apply the various cosmetic products. As another example, the display panel 134 can include images of drum kits. In this example, the compartment 152*a* can retain and display drumsticks and the compartment 152*b* can retain and display books of sheet music of drum parts for popular songs. In some embodiments, the main portion 154 can include text, images, or both to convey information to consumers. For example, main portion 154 can include text positioned behind the compartment 152*a* to indicate to customers that a product previously retained by the compartment 152*a* is still in stock and that customers can contact a sales associate to obtain the product.

By being positioned in front of the front surface of the display panel 134, the display rack 150 creates a three-dimensional effect for the elevated signage portion 130, thereby more readily attracting the attention of consumers than a substantially flat display. Additionally, the display racks 150 are readily releasable from the horizontal support 136, so each display rack 150 can be readily removed from the elevated signage portion 130 and mounted at a different position to quickly change the appearance of the display apparatus 100.

Figure 5A:
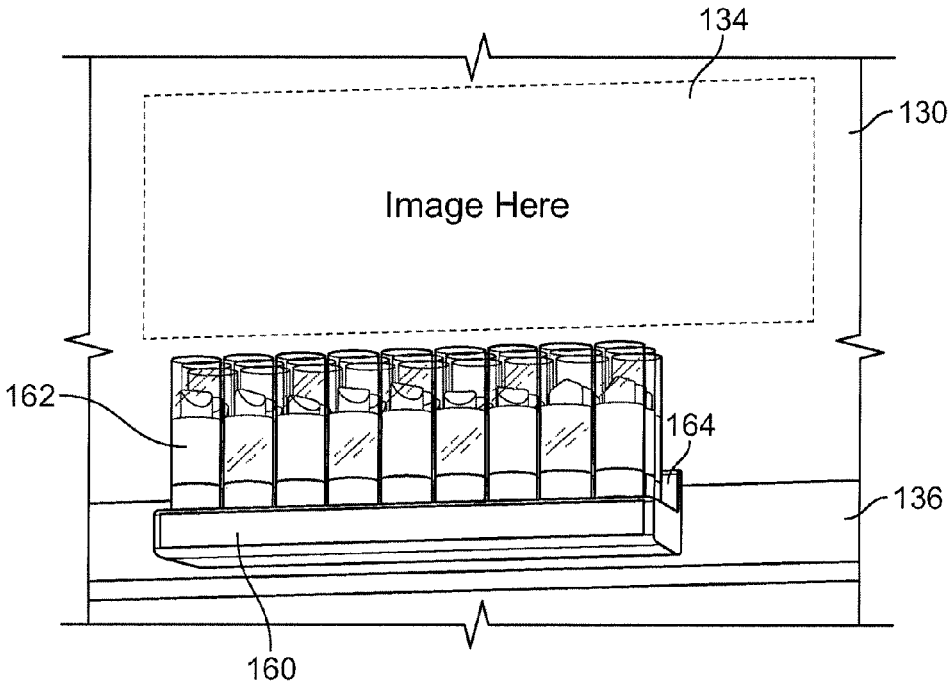
FIG. 5A is a perspective view of a display container for the elevated signage portion, in accordance with some embodiments.
Figure 5B:
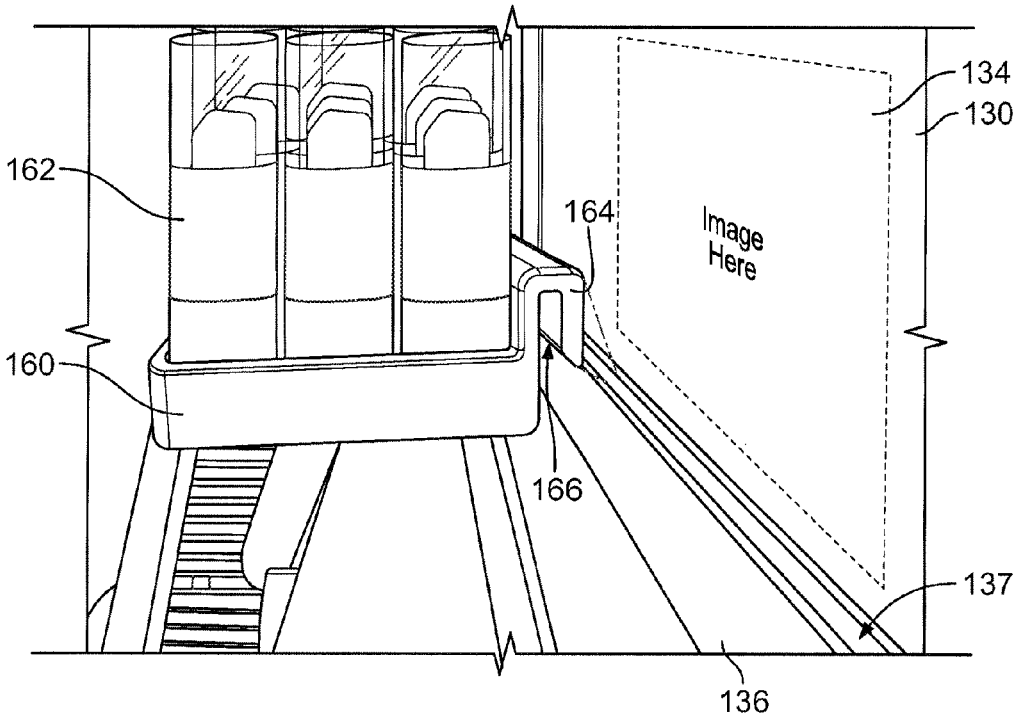
FIG. 5B is an exploded view of the display container of FIG. 5A in relation to a horizontal support, in accordance with some embodiments.
Figure 5C:
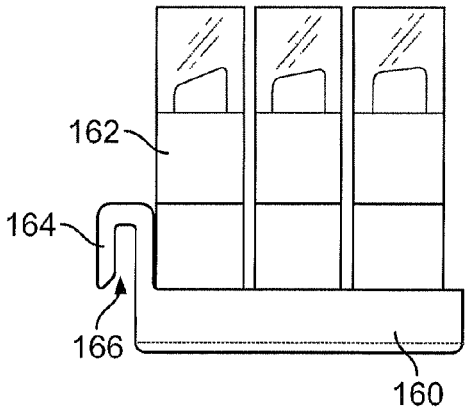
FIG. 5C is a side view of the display container of FIG. 5A.
Figure 5D:
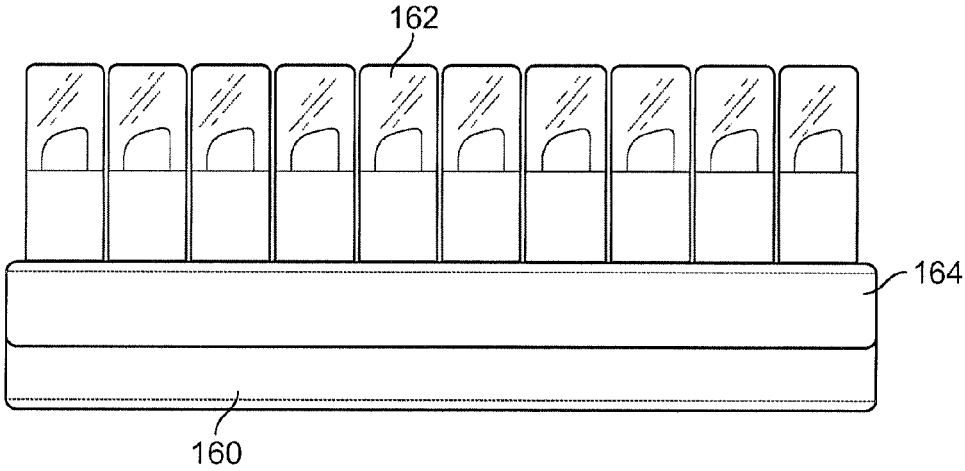
FIG. 5D is a rear view of the display container of FIG. 5A.
Figure 5E:
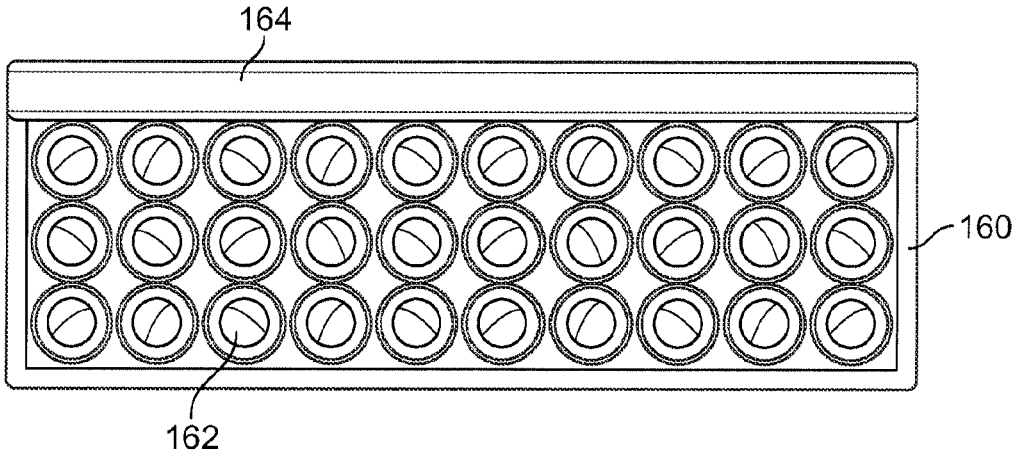
FIG. 5E is a top view of the display container of FIG. 5A.
Figure 5F:
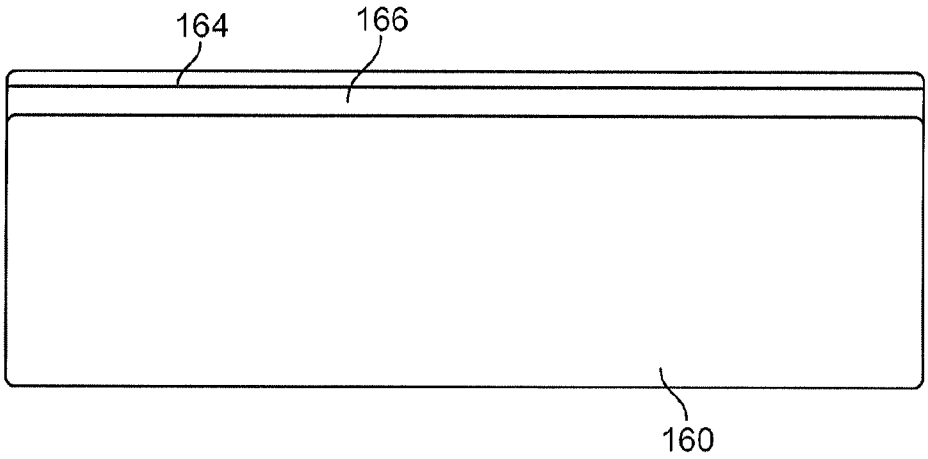
FIG. 5F is a bottom view of the display container of FIG. 5A.
Figure 6A:
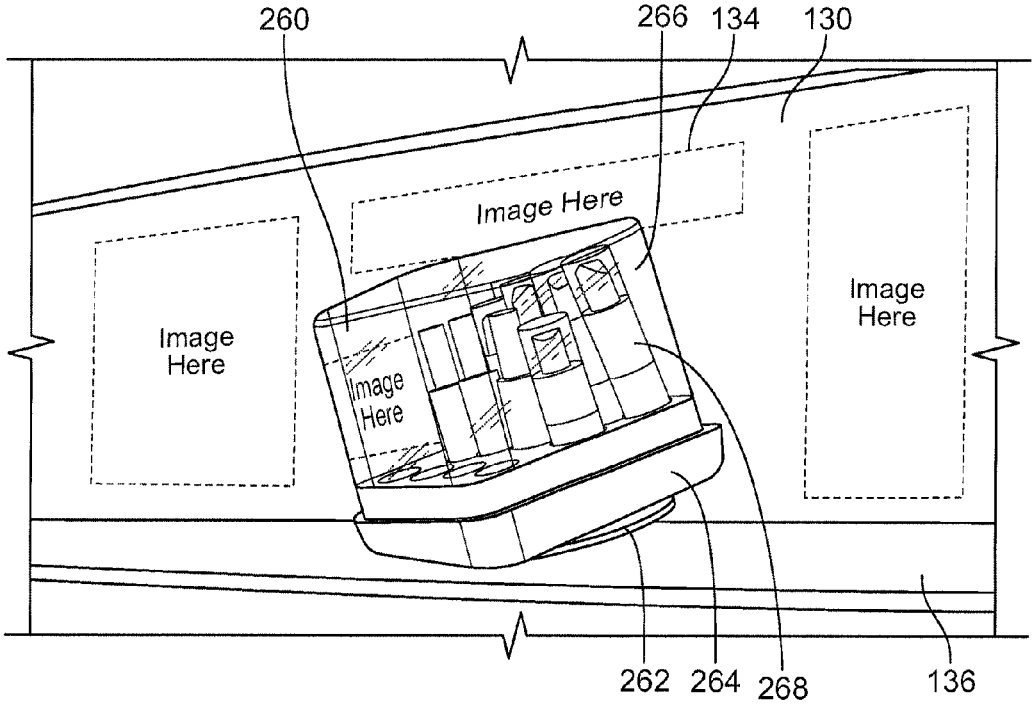
FIG. 6A is a perspective view of a display container, in accordance with other embodiments.
Figure 6B:
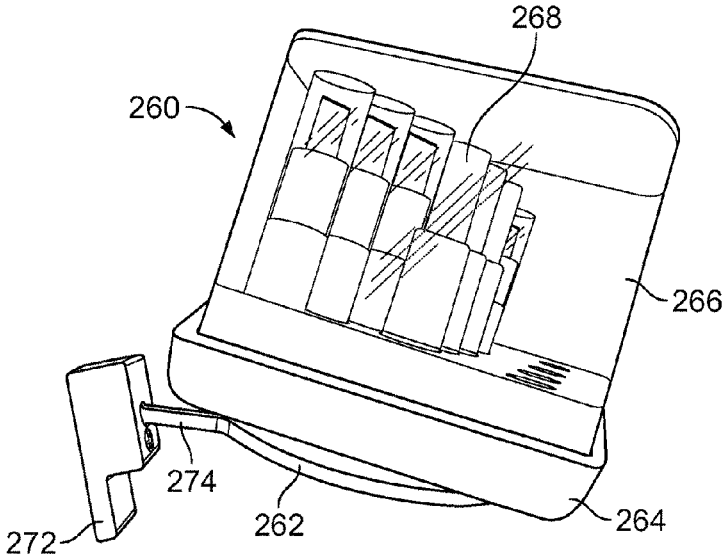
FIG. 6B is a side view of the display container of FIG. 6A.
Figure 6C:
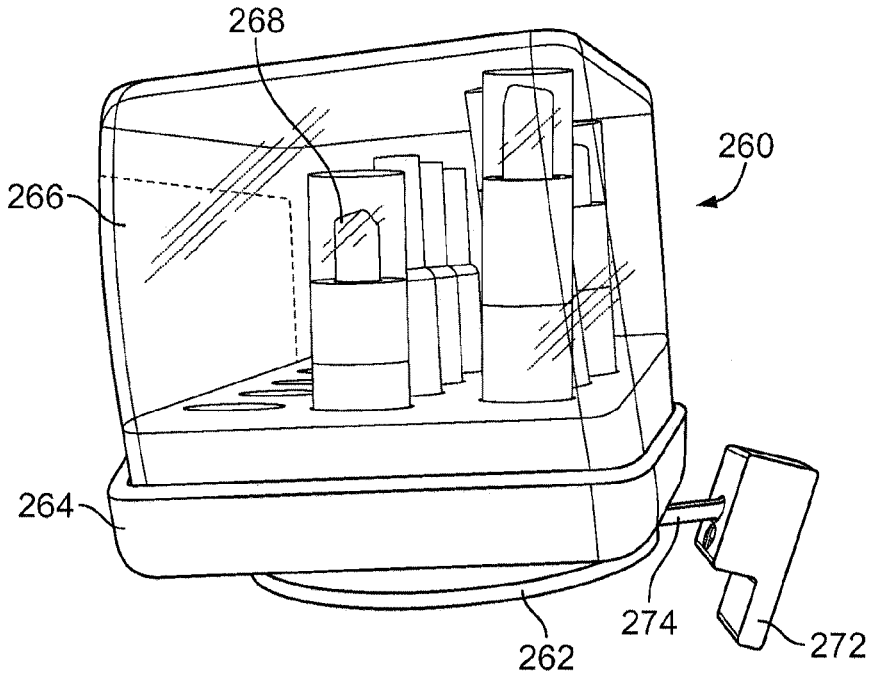
FIG. 6C is a side view of the display container of FIG. 6A.
Figure 6D:
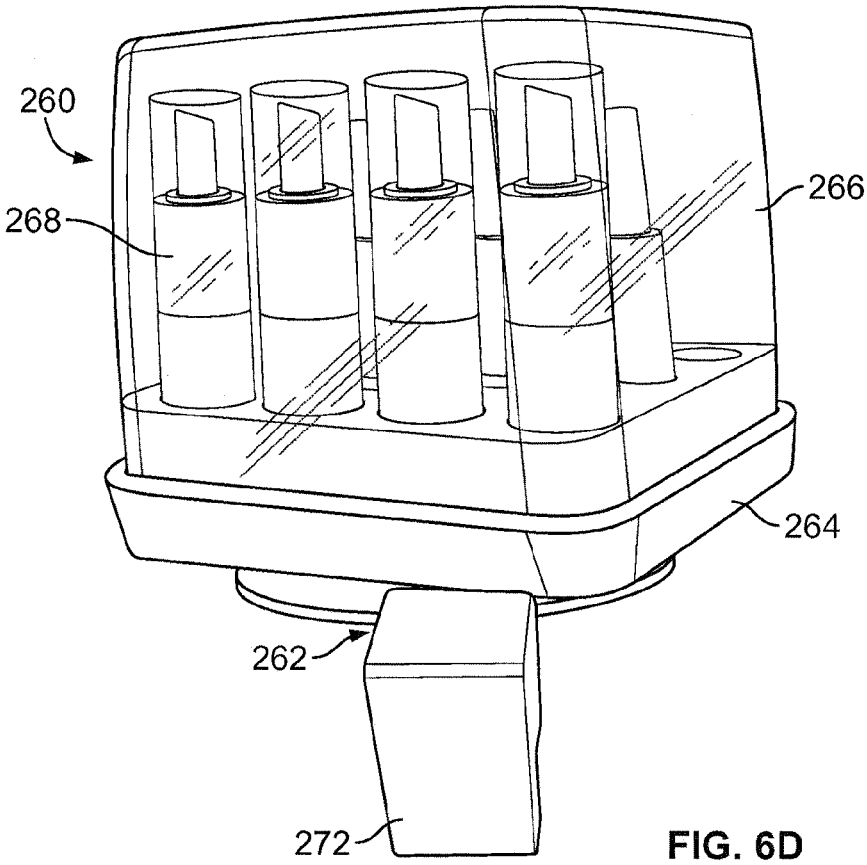
FIG. 6D is a rear view of the display container of FIG. 6A.
Figure 6E:
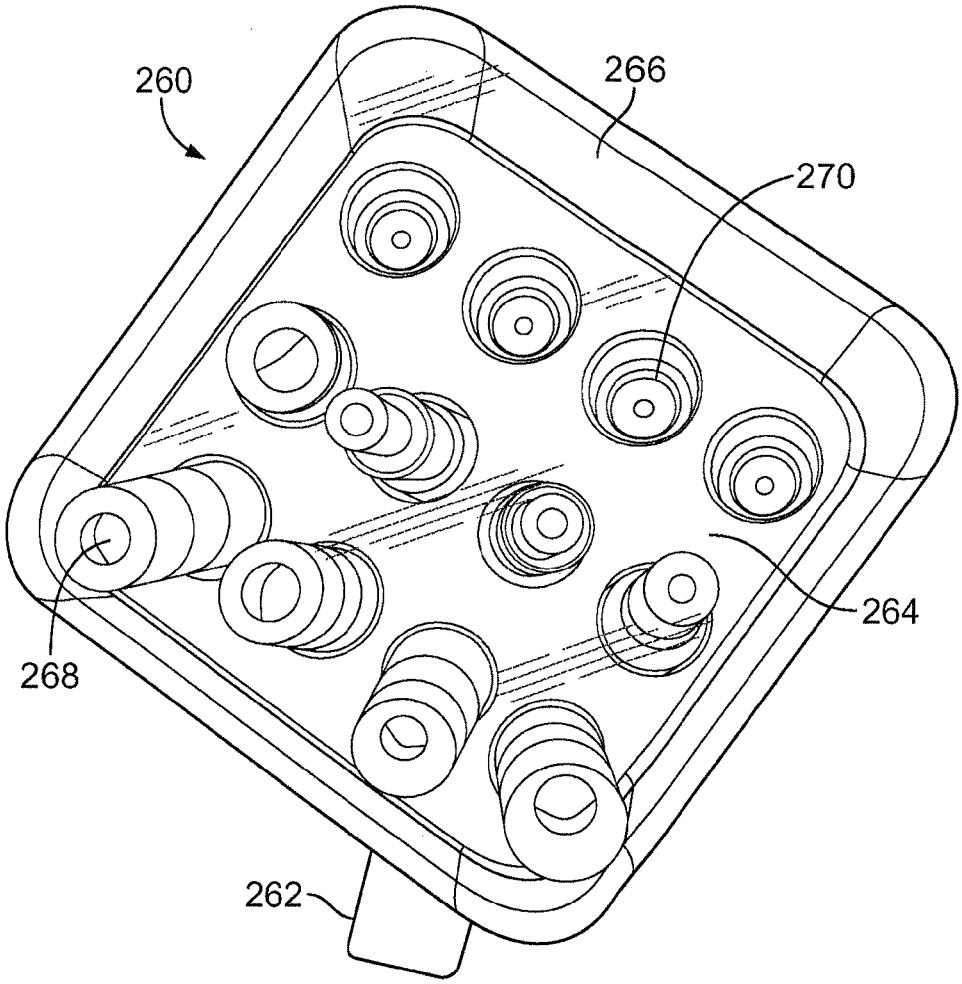
FIG. 6E is a top view of the display container of FIG. 6A.
Figure 6F:
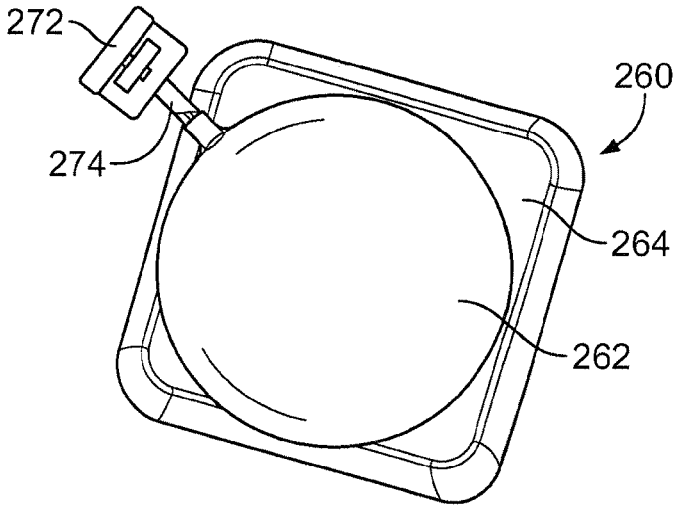
FIG. 6F is a bottom view of the display container of FIG. 6A.

Referring now to FIGS. 5A-5F, a display container 160 can retain a selected set of products 162 in a manner that draws added attention to those products 162. As depicted in FIGS. 5A and 5B, the display container 160 can be mounted to the horizontal support 136 of the elevated signage portion 130. The display container 160 can be positioned on the horizontal support 136 in front of a display panel 134, which is received by the first channel of the horizontal support 136 (described below in the connection with FIG. 7). The display container 160 includes a mounting clip 164 configured to engage a second channel 137 of the horizontal support 136, as shown in FIG. 5B. In some embodiments, the second channel 137 can be u-shaped (refer to FIG. 7) and includes two opposing inner sides that form right angles with a bottom surface as described above with reference to FIG. 4B. In some embodiments, the mounting clip 164 is configured to engage both of the opposing inner sides of the second channel 137. By engaging both of the opposing inner sides, the mounting clip 164 forms a readily removable friction fit with the second channel 137. The friction fit holds the display container 160 in place while allowing the display container 160 to be readily removed from the horizontal support 136 by hand without the use of handheld tools and repositioned elsewhere on the horizontal support 136 or on a different horizontal support. In some embodiments, the mounting clip 164 can easily slide within the second channel 137 to allow the display container 160 to be easily repositioned along the horizontal support 136.

In some embodiments, the mounting clip 164 defines a channel 166 of the display container 160. The channel 166 may include two opposing inner sides as described above for the second channel 137. The channel 166 can receive a front portion of the horizontal support 136. The front portion of the horizontal support can be wide enough to engage the two opposing inner sides of the channel 166 so as to create a friction fit. The friction fit can secure the display container 160 in place with respect to the horizontal support 136, while also allowing the display container to be readily removed in a toolless manner (e.g., without the use of handheld tools or the like).

Still referring to FIGS. 5A-5F, in accordance with some embodiments, the front or sides of the display container 160 can include images, text, or both related to the products 162 being retained and displayed by the display container 160. For example, the front of the display container 160 can include a logo related to the products 162. As another example, the products 162 can be various shades of lipstick and the front of the display container 160 can include text indicating the names of the various shades of lipstick. As yet another example, the sides of the display container 160 can include text indicating the price of the products 162. In some embodiments, the display panel 134 can include text, images or both relating to the products 162. For example, the large images of the products 162 so as to draw the attention of consumers from a large distance. When consumers approach the display panel 134, the close proximity of the display container 160 to the display panel 134 allows consumers to readily access the products 162 depicted on the display panel 134. As another example, the display container 160 can display a variety of cosmetic products and the display panel 134 can include images of one or more people wearing the cosmetic products. In some embodiments, the display panel 134 can include graphics or images to enhance the aesthetic appearance of a retail display that includes the display container 160.

As previously described, the display container 160 can be secured in an operative position forward of the front surface of the display panel 134 to thereby provide a three-dimensional effect to the elevated signage portion 130. Such an arrangement can reduce the amount of the display panel 134 that is concealed or obscured by the display container 160 and the products 162. Also, such an arrangement of the display container 160 can more readily attract the attention of consumers. Furthermore, the display containers 160 may be position in close proximity to the display panel 134 so that consumers can readily access, obtain, and purchase products marketed by the display panel 134 or elsewhere on a display apparatus 100.

Referring now to FIGS. 6A-6F, some alternative embodiments of a display container 260 may include a mounting portion 262, a base portion 264, and a top portion 266. The mounting portion 262 can be configured to mount to the horizontal support 136 of the elevated signage portion 130. As previously described, the horizontal support 136 can engage and support the display panel 134. In some embodiments, the top portion 266 can be all or partially transparent to allow consumers to view products 268 retained by the display container 260. In some embodiments, the top portion 266 can be locked or otherwise secured to the base portion 264 so that consumers are hindered from moving the products therein. In such circumstances, the generally transparent top portion 266 allows consumers to view the products 268 without being able to remove the products 268 from the display container 260. In other embodiments, the top portion 266 can be readily removed from the base portion 264 to allow consumers to gain access to the products 268. For example, the top portion 266 can form a friction fit with part of the base portion 264 to allow the top portion 266 to be lifted off of the top of the base portion 264. As another example, the top portion 266 can be coupled to the base portion 264 by a hinge mechanism to allow consumers to open the display container 260 and obtain one or more of the products 268.

In some embodiments, the base portion 264 of display container 260 includes one or more compartments 270 for receiving the products 268. For example, the base portion 264 can include one or more circular shaped compartments 270 for receiving lipsticks. As another example, the base portion can include one or more compartments 270 for receiving the handles of tooth brushes. By being configured to receive the products 268, the compartments 270 can retain the products 268 in a secure manner, thereby preventing the products 268 from falling over or becoming displaced when the display container 260 is moved or handled.

In some embodiments, the base portion 264 can be rotatably coupled to the mounting portion 262 to allow the base portion 264 to be rotated about a generally vertical axis with respect to the mounting portion 262. In some alternative embodiments, the axis of rotation can be substantially non-vertical. By being rotatable with relation to the mounting portion 262, the base portion 264 allows consumers to rotate the base portion 264 and top portion 266 to readily view the products 268 from a variety of angles. For example, the display container 260 may retain and display a shoe. By having a rotatable base portion 264, the display container 260 allows a consumer to view a number of sides of the shoe to more readily determine if the shoe has the look or style that the consumer desires. As another example, the products 268 can be lipsticks of various shades. By having a rotatable base portion 264, the display container 260 allows a consumer to more easily view all of the various shades of lipsticks than if the base portion 264 was positioned at a fixed position with relation to the mounting portion 262.

Still referring to FIGS. 6A-6F, in some embodiments, the mounting portion 262 includes a mounting tab 272 and a support arm 274. The mounting tab 272 is configured to engage a channel of the horizontal support 136 as described above for the mounting clip 164 of the display container 160 with reference to FIG. 5B. The support arm 274 extends from the mounting tab 272 to project the display container 260 out in front of the horizontal support 136, thereby creating a three-dimensional effect for the elevated signage portion 130. In some embodiments, the mounting tab 272 is configured to engage two opposing inner sides of the channel of the horizontal support 136. By engaging both of the opposing inner sides, the mounting tab 272 forms a readily removable friction fit with the channel. The friction fit holds the display container 260 in place while allowing the display container 260 to be readily removed from the horizontal support 136 by hand without the use of handheld tools and repositioned elsewhere on the horizontal support 136 or on a different horizontal support. In some embodiments, the mounting tab 272 can easily slide within the channel to allow the display container 260 to be easily repositioned along the horizontal support 136.

In some embodiments, the display panel 134 can include text, images or both relating to the products 268 in the display container 260. For example, the display container 260 can include a display of the inside of a golf ball. The display panel can include text and images conveying details of the various layers of the golf ball and indicating advantages of using the displayed golf ball over other golf balls. In some embodiments, the display container 260 can include images or text relating to the products 268. For example, the products 268 can be various cosmetic products and a side of the top portion 266 can include an image of a person wearing some or all of the cosmetic products. As another example, one or more of the sides of the top portion 266 can include text indicating the prices of one or more of the products 268.

Similar to previously described embodiments, the display container 260 can be secured in an operative position forward of the front surface of the display panel 134 to thereby provide a three-dimensional effect to the elevated signage portion 130. Such an arrangement can reduce the amount of the display panel 134 that is concealed or obscured by the display container 260 and the products 268. Also, such an arrangement of the display container 260 can more readily attract the attention of consumers. Furthermore, the display containers 260 may be position in close proximity to the display panel 134 so that consumers can readily access, obtain, and purchase products marketed by the display panel 134 or elsewhere on a display apparatus 100.

Figure 7:
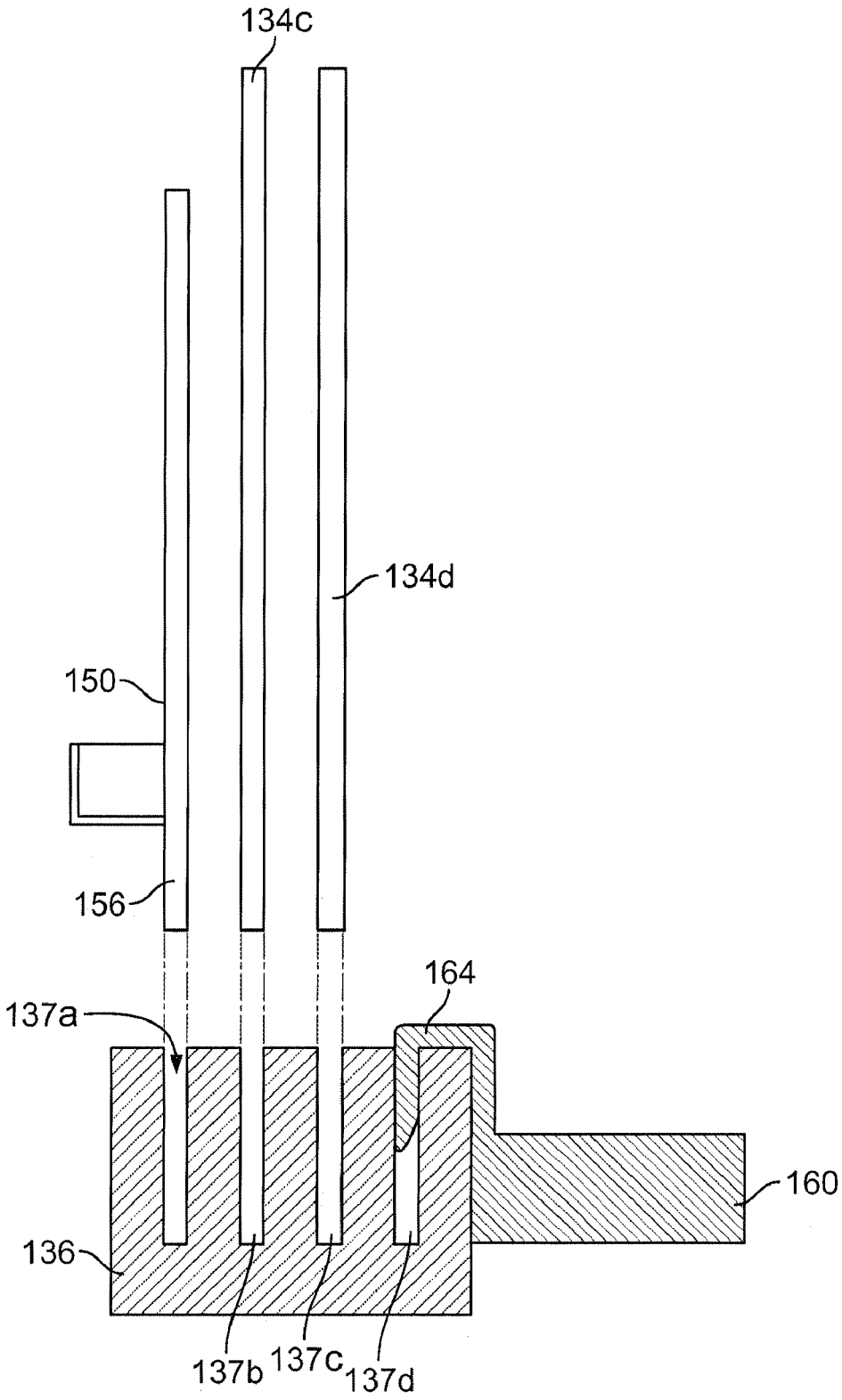
FIG. 7 is an exploded cross section view of a removable display rack, display panels, and a display container in relation to a horizontal support, in accordance with some embodiments.

Referring now to FIG. 7, in accordance with some embodiments, the elevated signage portion 130 can include a horizontal support 136 that defines a plurality of channels 137*a-d* for receiving a number of display panels 134, display racks 150, and display containers 160 or 260. In the example depicted, each of the channels 137*a-d* is generally u-shaped with each channel 137*a-d* having two opposing inner sides and a generally flat bottom surface. In some embodiments, the channels can be shapes other than u-shaped. For example, the channels can be partially v-shaped at the bottom. As previously described in connection with FIG. 1, the outer channels 137*a* and 137*d* are configured to receive one or more display racks 150 (FIGS. 4A-B), one or more display containers 160 (FIGS. 5A-F) or 260 (FIGS. 6A-F), or a combination thereof. For example, the display rack 150 can be mounted to the channel 137*a* to face toward a first aisle bordering the display apparatus 100 (FIG. 1) while the display container 160 can be mounted to the channel 137*d* to extend toward a second opposing aisle bordering the display apparatus 100. In some embodiments, the channels 137*a* and 137*d* can each receive a plurality of display racks 150 and display containers 160, 260 at the same time.

As previously described in connection with FIGS. 4A-B, the display rack 150 includes the mounting portion 156 that is configured to engage the channel 137*a*. The mounting portion 156 has front and rear surfaces for engaging the opposing inner sides of the channel 137*a* to create a friction fit. The friction fit can releasably secure the display rack 150 within the channel 137*a* while allowing the display rack 150 to be readily removed from the horizontal support 136 without the use of handheld tools. In some embodiments, the mounting portion 156 can posses a vertical length sufficient to allow the mounting portion 156 to contact the bottom surface of the channel 137*a* when the display rack 150 is retained by the channel 137*a*. In some embodiments, the mounting portion 156 is not configured to contact the bottom surface of the channel 137*a*.

As previously described in connection with FIGS. 5A-F, the display container 160 includes the mounting clip 164 that is configured to engage the channel 137*d*. The mounting clip 164 engages the opposing inner sides of the channel 137*d* to create a friction fit. The friction fit can releasably secure the display container 160 within the channel 137*d* while allowing the display container 160 to be readily removed from the horizontal support 136 without the use of handheld tools. In some embodiments, the mounting clip 164 can posses a vertical length sufficient to allow the mounting clip 164 to contact the bottom surface of the channel 137*d* when the display container 160 is retained by the channel 137*d*. In some embodiments, the mounting clip 164 is not configured to contact the bottom surface of the channel 137*d*. It should be understood from the description herein that the mounting tab 272 of the second display container 260 (FIGS. 6A-F) can also engage the channel 137*d* as described above.

Still referring to FIG. 7, in accordance with some embodiments, the inner channels 137*b* and 137*e* are configured to retain side-by-side display panels 134*c* and 134*d* respectively. As previously described in connection with FIGS. 1-2, each of the display panels 134*c-d* can include images and text of a front face for conveying information to consumers while the rear faces of the display panels 134*c-d* face inwardly toward one another. For example, the first display panel 134*c* can be mounted to the channel 137*b* to face toward the first aisle bordering the display apparatus 100 (FIG. 1), and the second display panel 134*d* can be mounted to the channel 137*c* to extend toward the second opposing aisle bordering the display apparatus 100. In some embodiments, the display panels 134*c-d* can retain embedded display windows as described above in connection with FIGS. 2 and 3. The channels 137*b* and 137*c* can be configured to be approximately the same width as the display panels 134*c* and 134*d*. The channels 137*b* and 137*c* can secure the display panels 134*c* and 134*d* in an upright operative position by engaging the bottom edges of the display panels 134*c* and 134*d* with the bottom surfaces of the channels 137*b* and 137*c* and by contacting portions of the front and rear surfaces of the display panels 134*c* and 134*d* with the opposing inner surfaces of the channels 137*b* and 137*c*. The display panels 134*c* and 134*d* are secured within the channels 137*b* and 137*c* by a friction fit to allow the display panels 134*c* and 134*d* to be readily removed from the horizontal support 136. In some embodiments, the display panels 134*c* and 134*d* can be removed from the horizontal support 136 and replaced by other display panels that include different text or images, thereby altering the appearance of the display apparatus 100 without having to install an entirely new apparatus 100. In other embodiments, the display panels 134*c* and 134*d* can be removed from the horizontal support 136 and placed in a different horizontal support 136 of the same display apparatus 100.

Accordingly, as shown in FIG. 7, the horizontal support for each of the elevated signage portions 130 (FIGS. 1-2) can define four channels 137*a-d* so as to provide attention-drawing signage on opposing sides of the display apparatus 100. In other embodiments, the horizontal support 136 can include more or less than four channels. For example, the horizontal support 136 can include three channels. In such circumstances, the middle channel can retain a display panel with text, images, or both on both sides while the two outer channels can retain display racks and display containers as described above. As another example, the horizontal support can include five channels. In some embodiments in which the horizontal support includes five channels, the left most channel can retain a first display rack, the next two channels can retain first and second display panels, the fourth channel can retain a second display rack facing in the opposite direction of the first display rack and the fifth channel can retain a display container positioned in front of the second display rack.

A number of embodiments of the invention have been described. Nevertheless, it will be understood that various modifications may be made without departing from the spirit and scope of the invention. Accordingly, other embodiments are within the scope of the following claims.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method for displaying products, comprising:

arranging a product display apparatus between a first store aisle and an adjacent store aisle, the product display apparatus including a first set of horizontal shelf surfaces facing toward the first store aisle and disposed between opposing divider walls, a second set of horizontal shelf surfaces facing toward the adjacent store aisle and disposed between the opposing divider walls, and at least one rear wall separating the first and second sets of horizontal shelf surfaces;

placing a plurality of products on the first and second sets of horizontal shelf surfaces so that the plurality of products are accessible from at least one of the first store aisle and the adjacent store aisle;

mounting an image-bearing panel in an elevated position above the rear wall of the product display apparatus so as to define a see-through opening between the image-bearing panel and the rear wall, the see-through opening providing visibility at a selected height range from the first store aisle to the adjacent store aisle, the image-bearing panel including a front surface having images related to at least one of the products accessible from at least one of the first store aisle and the adjacent store aisle;

positioning vertical supports to extend above each of the opposing divider walls and above the image-bearing panel;

inserting one or more embedded display window structures into one or more corresponding cavities formed in the front surface of the image-bearing panel such that a front face of each embedded display window structure is positioned forward of the front surface of the image-bearing panel, each embedded display window structure carrying one or more products or images related to at least one of the products accessible from at least one of the first store aisle and the adjacent store aisle;

mounting a horizontal sign support arm to vertical support mounts extending above an upper edge of the rear wall so that the horizontal sign support arm is spaced above the upper edge of the rear wall, the horizontal sign support arm defining a plurality of channels that each extend in a generally horizontal direction, at least one of the channels configured to retain the image-bearing panel in a vertical orientation in the elevated position above the rear wall; and toollessly mounting a product display container to the horizontal sign support arm in an elevated position above the upper edge of the rear wall so that the product display container is positioned above the first or second set of horizontal shelf surfaces and forward of the front surface of the image-bearing panel, wherein the product display container defines a space to releasably receive one or more products.

2. The method of claim 1, wherein at least a portion of one embedded display window structure is generally transparent so as to show the one or more products arranged in an internal space of the embedded display window structure.

3. The method of claim 1, wherein mounting the image-bearing panel in the elevated position above the rear wall of the product display apparatus defines the see-through opening at the selected height range from about 54 inches to about 68 inches above a base of the product display apparatus.

4. A method for assembling a product display apparatus, comprising:

supporting a plurality of product display shelves in a generally horizontal direction between opposing divider walls and forward of a rear wall, each of the product display shelves defining an upper surface to support a plurality of products;

mounting an elevated signage portion above the plurality of product display shelves, the elevated signage portion including a horizontal support arm that is spaced above an upper edge of the rear wall, the horizontal support arm defining a plurality of channels that each extend in the generally horizontal direction;

extending a signage display panel substantially the entire distance between the opposing divider walls and releasably engaging the signage display panel with one of the channels of the horizontal support arm so that an image-bearing surface of the signage display panel is retained in a generally vertical orientation;

securing a plurality of vertical supports to extend above the opposing divider walls and above the signage display panel; and toollessly mounting a display container to one of the channels of the horizontal support arm and retaining the display container in a position above the product display shelves and forward of the image-bearing surface of the signage display panel, the display container defining a space to releasably receive a plurality of products, wherein the elevated signage portion is mounted above the plurality of product display shelves so as to define a see-through visibility gap between the elevated signage portion and the product display shelves, wherein the see-through visibility gap is substantially unobstructed and open between the opposing divider walls so as to provide viewability to an opposing side of the display apparatus, wherein the horizontal support arm is disposed above the see-through visibility gap and is sized and configured to support a consumer product, and wherein the divider walls extend above the see-through visibility gap.

5. The method of claim 4, comprising spacing the horizontal support arm of the elevated signage portion above the upper edge of the rear wall to define the see-through visibility gap therebetween.

6. The method of claim 5, comprising arranging a bottom edge of the see-through visibility gap at a height of about 54 inches to about 68 inches.

7. The method of claim 4, comprising providing the see-through visibility gap with a vertical dimension of about 4 inches to about 18 inches.

8. The method of claim 4, wherein the horizontal support arm of the elevated signage portion defines at least a pair of outer channels and a pair of inner channels that are each extended in the generally horizontal direction.

9. The method of claim 8, wherein at least one of the inner channels comprises opposing channel walls separated by a width, the method further comprising frictionally engaging the opposing channel walls with a lower edge portion of the signage display panel to retain the signage display panel in the generally vertical orientation.

10. The method of claim 8, wherein the display container includes a mounting bracket extending from a container base, the method comprising mating the mounting bracket with at least a portion of one of the outer channels so that the container base is positioned above the product display shelves and forward of the signage display panel.

11. The method of claim 4, comprising coupling the elevated signage portion to the upper edge of the rear wall by at least one vertical support, the at least one vertical support defining a height of the see-through visibility gap.

12. The method of claim 4, further comprising extending horizontal supports between the vertical supports.

13. A method of assembling a product display apparatus, comprising:

providing a shelf support section separating a first store aisle from a second store aisle and extending generally parallel to the first and second store aisles, the shelf support section including a base, an upper edge opposite the base, and a vertical array of product support surfaces extending in a horizontal direction between a plurality of vertical side supports and divider walls, the vertical array of product support surfaces being positioned above the base and below the upper edge;

mounting a sign support member generally parallel to the upper edge of the shelf support section such that the sign support member and the shelf support section cooperatively define a viewing gap, the bottom edge of the viewing gap being positioned at a height of about 54 inches to about 68 inches and wherein the viewing gap extends vertically for a distance of about 4 inches to about 18 inches;

removably mounting a product display sign to the sign support member in an elevated position above the upper edge of the shelf support section, the product display sign including one or more images on a front surface that is retained in a generally vertical orientation when the product display sign is removably mounted to the sign support member;

wherein the sign support member is coupled to the shelf support section by at least one vertical support, the at least one vertical support defining a height of the viewing gap, wherein except for the at least one vertical support, the entire viewing gap is unobstructed and open between the plurality of vertical side supports so as to provide line-of-sight viewing between the first and second aisles, wherein the sign support member is disposed above the viewing gap and is sized and configured to support a consumer product, and wherein the divider walls extend above the viewing gap; and extending a plurality of vertical supports above the divider walls and above the product display sign.

14. The method of claim 13, further comprising removably mounting a display container to the sign support member in an elevated position above the upper edge of the shelf support, and suspending the display container above the vertical array of product support surfaces and forward of the front surface of the product display sign.

15. The method of claim 14, wherein the display container defines a space to releasably receive a plurality of products in the position suspended above the vertical array of product support surfaces, the display container having a shape that is different from the product support surfaces.

16. The method of claim 13, comprising mounting the sign support member to the upper edge of the shelf support section by one or more vertical supports.

17. The method of claim 13, wherein the product display sign includes one or more cavities formed in the front surface, the method further comprising removably receiving a display window box in each of the one or more cavities such that a front face of the display window box is positioned forward of the front surface of the product display sign, the display window box carrying one or more products or product images.

18. The method of claim 13, wherein the sign support member defines a plurality of horizontal channels, the method comprising frictionally engaging a lower edge portion of the product display sign with one of the horizontal channels of the sign support member.

* * * * *